United States Patent [19]

Jones et al.

[11] Patent Number: 4,774,871

[45] Date of Patent: Oct. 4, 1988

[54] BRAIDING MACHINES

[75] Inventors: John R. Jones, Wirral; John P. Ricketts, Bolton; Maurice C. Williams, Nr. Wigan, all of England

[73] Assignee: Babcock Wire Equipment Limited, Bolton, England

[21] Appl. No.: 70,309

[22] Filed: Jul. 6, 1987

[30] Foreign Application Priority Data

Jul. 4, 1986 [GB] United Kingdom ..... 8616331

[51] Int. Cl.[4] ..... D04C 3/06; D04C 3/20; D04C 3/38

[52] U.S. Cl. ..... 87/50; 87/44; 87/45

[58] Field of Search ..... 87/44–47, 87/50, 51, 33

[56] References Cited

U.S. PATENT DOCUMENTS

| | | | |
|---|---|---|---|
| 1,906,946 | 5/1933 | Bornemann | 87/50 |
| 2,458,379 | 1/1949 | Hobourn et al. | 87/50 |
| 3,748,952 | 7/1973 | Petzetakis | 87/50 |
| 3,783,736 | 1/1974 | Richardson | 87/50 X |
| 3,795,171 | 3/1974 | Strangfeld | 87/50 |
| 3,981,223 | 9/1976 | Ostermann | 87/44 X |

FOREIGN PATENT DOCUMENTS 1315370 5/1973 United Kingdom .

*Primary Examiner*—John Petrakes

*Attorney, Agent, or Firm*—Shlesinger, Arkwright, Garvey

[57] ABSTRACT

A braiding machine of the maypole form having co-acting horngear assemblies positioned in a cylindrical housing and arranged to drive spool carriers along a double undulating and intersecting drive track groove as groups in opposed directions. The form of the groove is such as to avoid discontinuities both in normal and in tangential components of acceleration forces on the spool carriers. Drive is transmitted from the horngear assemblies to the spool carriers by drive forks each carried on a pivot shaft mounted for oscillating rotation through restricted arc on the respective horngear assembly. Oscillating rotation of the drive forks is effected by a cam follower arrangement engaging a cam track such that the drive forks propel the spool carriers along the guide track groove with constant or substantially constant linear velocity.

6 Claims, 2 Drawing Sheets

BRAIDING MACHINES

This invention relates to braiding machines for producing a sheathing comprising a multiplicity of interwoven strands and, more particularly, but not exclusively, a braiding machine of the so-called maypole type in which strand spool carriers follow contra-rotating circular paths of undulating and intersecting form.

In GB-A-1 315 370 there is disclosed a braiding machine of the maypole type having a multiplicity of spool carriers each provided with follower means arranged to co-act with a fixed circular guide track of double undulating and intersecting form and with drive means arranged to engage with recesses on horngears arranged in a circular, meshing array and respectively carried on pillars positioned centrally of the individual undulations. Upon driving the horngears the recesses propel the spool carriers along the undulating and intersecting guide track such that one group of carriers moves in a circular direction and the other group of carriers moves in the opposed circular direction and, following the intersecting undulations, alternatingly pass radially inwardly and radially outwardly of each other. Strands of the spool carriers are paid off to form a braided sheathing co-axially of the central axis of the braiding machine by virtue of the contra-rotating intersecting undulating paths of the spool carriers.

GB-A-1 315 370 proposes that previous arrangements in which the undulations of the guide track were formed by curves connected by straight lines in the region of the intersections be modified such that the undulations are constituted solely by constant radius curves reversing in direction of curvature at the intersections.

In practice, braiding machines having guide tracks consisting of either circular arcs connected by straight lines or intersecting constant radius arcs are limited in the speed at which sustained operation is possible, due to the noise and wear produced as a result of discontinuities in acceleration forces acting on the spool carriers during movement along the guide track.

According to the present invention there is provided a braiding machine having a multiplicity of spool carriers each provided with follower means arranged to co-act with a fixed, generally circular, guide track of double undulating and intersecting form and with drive means arranged to engage with recesses on horngear assemblies driven by a circular array of meshing gear wheels respectively carried on pillars positioned centrally of the individual undulations in which the motion of the spool carriers is arranged to be of a form avoiding discontinuities both in normal and in tangential components of acceleration forces on the spool carrier upon moving around the guide track.

Figure 1:
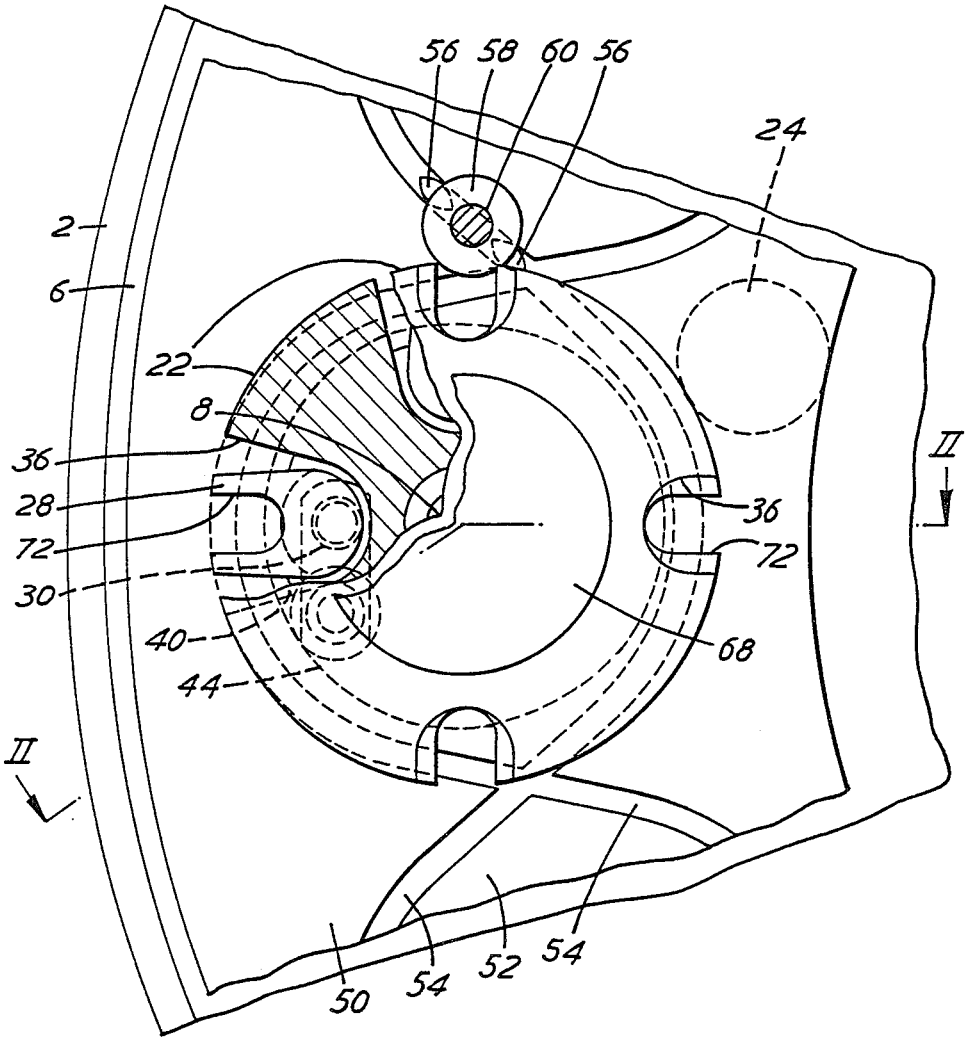
Figure 2:
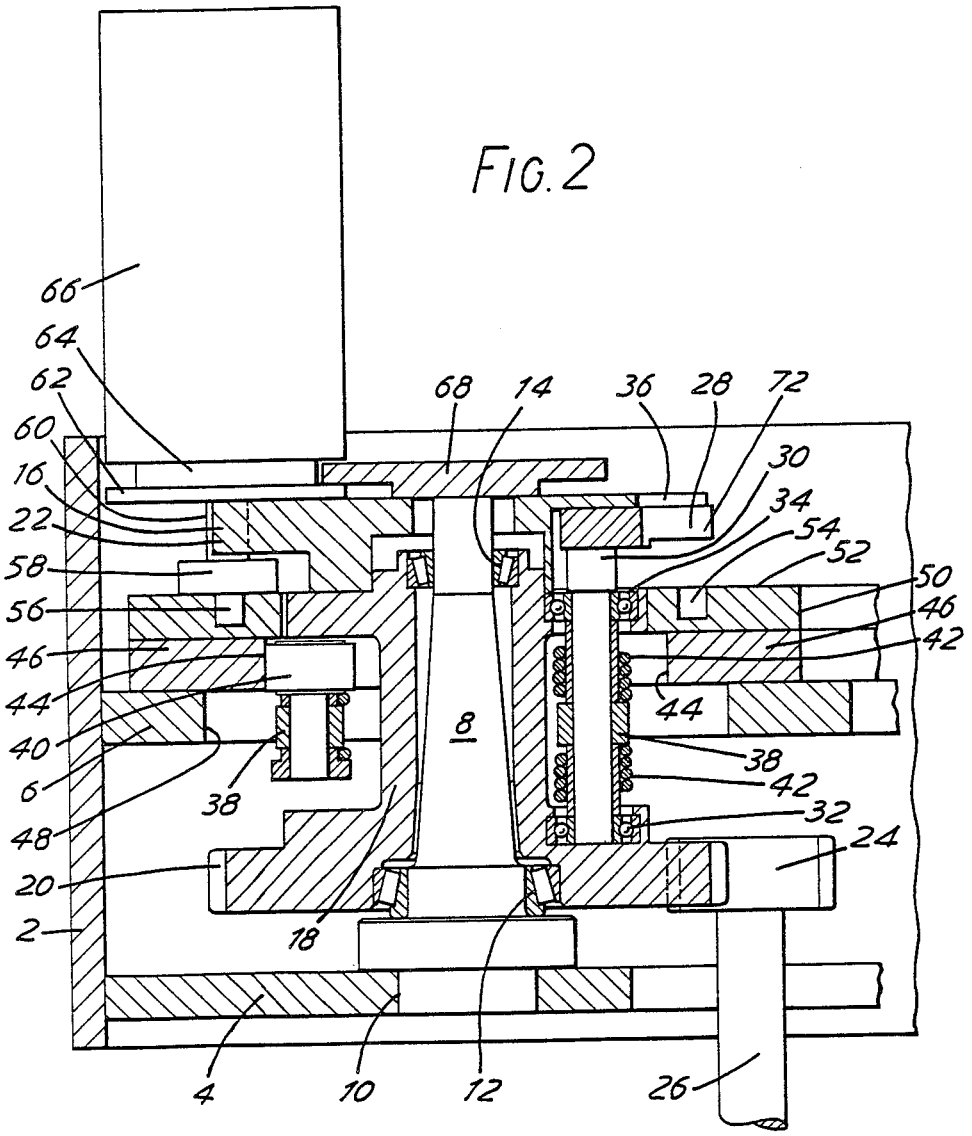

The invention will now be described, by way of example, with reference to the accompanying, partly diagrammatic, drawings, in which:

FIG. 1 is a plan view of an annular portion of a braiding machine, with a part of a top plate and a layered part of a horngear plate broken away and spool carriers, with the exception of a base portion of one, together with adjoining horngear assemblies omitted for the sake of clarity; and FIG. 2 is a cross-sectional elevation taken on the line II—II of FIG. 1 with parts not in the plane of section omitted but showing a spool carrier in position.

Referring to the drawings, the braiding machine is formed with a fixed cylindrical housing 2 supporting an annular base plate 4 and an annular face plate 6. Twelve tapered posts 8 are secured in apertures 10 spaced equiangularly on a common pitch circle in the base plate 4. Each tapered post 8 carriers, on roller bearings 12, 14, a horngear assembly 16 including a hollow sleeve 18 provided, at an end portion adjacent the base plate 4, with a toothed gear wheel 20 and, at an end portion remote from the base plate 4, with a horngear plate 22. The toothed gear wheels 20 of respective adjacent horngear assemblies intermesh and are driven from a toothed pinion wheel 24, on a drive shaft 26, intermeshing with one of the toothed gear wheels 20.

Each horngear assembly includes four driving forks 28 mounted on pivot shafts 30 carried in bearings 32, 34 located at 90° intervals on the hollow sleeve 18 and positioned for rotation in a restricted arc adjacent the horngear plate 22 in register with stepped recesses 36 in the horngear plate. Each driving shaft has keyed thereto a follower arm 38 carrying a cam roller follower 40 urged by springs 42 into contact with a cylindrical cam track surface 44 formed on a respective cam plate 46 secured to the face plate 6 in register with a related circular aperture 48 therein co-axial with the associated tapered posts 8.

An annular guide track plate 50 is secured to the face plate 6 and the cam plate 46 and, on a face 52 remote from the base plate 4 and the cam plate 46, is formed with a double undulating and intersecting groove 54 accommodating boat shaped sliders 56 connected, in pairs, to bridge pieces 58. Mounted centrally of each bridge piece 58 is a carrier pillar 60 formed with a collar 62 slidably seating on the horngear plate 22 and with a connection means 64 for a carrier 66 for a strand spool or bobbin (not shown). A stepped top plate 68 secured to the horngear plate 22 serves to retain the collar 62 in contact with the horngear plate 22.

Jaw faces 72 of the driving forks 28 co-act with the carrier pillars 60 to transmit drive force thereto.

In operation, with carriers 66 loaded with strand spools positioned in appropriate stepped recesses 36 in each horngear plate 22, and with a core feed along the central axis of the braiding machine and strands from the spools attached to the core, the drive means are energised to rotate the horngear assemblies 16. Rotation of the horngear assemblies produces movement of the carrier boat-shaped sliders 56 along the undulating and intersecting guide track grooves 54 by engagement of the jaw faces 72 of the driving forks 28 with the carrier pillars 60. Since the carriers 66 move as two groups, one group moving clockwise and the other group moving counter-clockwise, the strand spools on the carriers follow paths which cross and produce a braided sheating on the core feed.

The form of the undulations in the guide track is such as to avoid discontinuities both in normal and in tangential components of acceleration forces on the spool carrier upon moving around the guide track. Thus adjacent the intersections, the track has a varying curvature intermediate a constant radius and a straight line. The profile of the guide track is determined, for the radially outer face of each undulation, by the relationship $$X = R_i \cos \theta_n$$

$$Y = R_i \sin \theta_n$$

where:

X, Y are the cartesian co-ordinates of points on the profile of the radially outer face of a guide track undulation $R_i$ is a polynomial of the form $$R_i = C_1 + \theta_i(C_2 + \theta_i(C_3 + \theta_i(C_4 + \theta_i(C_5 + \theta_i \cdot C_6))))$$

where:

$\theta_i$ is the angular displacement from the Y axis normalised to lie between 0 and 1 and is denormalised by the relationship $$\theta_n = \theta_i(\theta_f - \theta_s) + \theta_s$$

$\theta_n$ is the total angular displacement from the Y axis $\theta_s$ is the angular displacement of the start of the profile curve leading from a circular arc portion $\theta_f$ is the angular displacement of the finish of the profile curve leading to a circular arc portion $C_1$ to $C_6$ are polynomial coefficients.

The profile of the inner face of each undulating groove 54 is determined by modifying the co-ordinates of the adjoining portion of the radially outer face to accommodate the instantaneous spacing of the carrier boat-shaped sliders 56 from the radially outer face—which depends upon the instantaneous distance between the points of the slider in contact with the radially outer face and the central width of the slider.

The profile of the fixed cam track surface 44 is determined such that the velocity of a spool carrier 66 along the undulating groove 54 is constant or substantially constant, rotation of the swinging driving fork 28 augmenting or decreasing the angular velocity of the horngear plate 22 to achieve this.

The co-ordinates Cpx(i); Cpy(i) of the profile are given by the relationship:

$$Cpx(i) = Cx(i) + r_r \cos\left(\tan^{-1}\left\{\frac{(Py(i-1) - Py(i+1)}{(Px(i-1) - Px(i+1)}\right\} - \frac{\pi}{2}\right)$$

$$Cpy(i) = Cy(i) + r_r \sin\left(\tan^{-1}\left\{\frac{(Py(i-1) - Py(i+1)}{(Px(i-1) - Px(i+1)}\right\} - \frac{\pi}{2}\right)$$

Where Cx(i) and Cy(i) are the co-ordinates of the centre of the roller cam and are given by the relationship:

$$Cx(i) = L_1 \cos\left[\tan^{-1}(py(i)/px(i) + L_2 \cos\left(\beta_2 + \tan^{-1}\left\{\frac{(y_e(i) - py(i)}{(x_e(i) - px(i)}\right\}\right)\right.$$

$$Cy(i) = L_1 \sin\left[\tan^{-1}(py(i)/px(i) + L_2 \sin\left(\beta_2 + \tan^{-1}\left\{\frac{(y_e(i) - py(i)}{(x_e(i) - px(i)}\right\}\right)\right.$$

Where px(i) and py(i) are the co-ordinates of the follower pivot point and are given by the relationship:

$$px(i+1) = L_1 \cos(\alpha + i \cdot \alpha_1)$$

$$py(i+1) = L_1 \sin(\alpha + i \cdot \alpha_1)$$

Where $\alpha$ is $2\pi$/number of carriers $\alpha_1$ is an angular increment $L_1$ is the pivot radius i is the $\alpha$ counter $\beta_2$ is the follower angle $L_2$ is the follower arm length.

$X_e(i)$ and $y_e(i)$ are the re-distributed co-ordinates of the carrier center.

$r_r$ is the roller radius.

Thus, the action of the cam roller followers 40 is to produce an oscillating restricted rotation of the swinging driving forks 28 as the horngear rotates such that the sliders 56 are propelled along the undulating groove 54 with constant or substantially constant velocity by varying the angular velocity of the boats depending upon their position along the undulating groove.

By virtue of the form of the profile of the undulating groove, discontinuities in both the normal and tangential components of acceleration forces acting on the carrier 66 are avoided or largely avoided, thereby enabling the machine to be operated at a relatively higher speed and making for quieter running conditions as well as a reduction in wear.

It will be appreciated that whilst the invention has been described in conjunction with a maypole type braider, it is also applicable to other forms of braiders in which a guide track is utilised to produce movement of strand spools or strands.

We claim:

1. A braiding machine having a fixed, generally circular guide track of double undulating and intersecting form having radially inner and outer faces;

a multiplicity of spool carriers each provided with follower means, the follower means being arranged to co-act with the guide track to constrain motion of the spool carriers around the guide track;

horngear assemblies respectively each carried on respective posts positioned centrally of the individual undulations of the guide track;

a circular array of meshing gear wheels drivingly connected to the horngear assemblies;

drive means on the spool carriers arranged to be engageable by recesses on the horngear assemblies;

wherein the motion of the spool carriers around the guide track is of a form avoiding discontinuities both in normal and in tangential components of acceleration forces on the spool carriers and the profile of the radially outer face of the undulations of the guide track approximates to a form determined by a relationship $$X = R_i \cos \theta_n$$

$$Y = R_i \sin \theta_n$$

where:

X, Y are the cartesian co-ordinates of points on the profile of the radially outer face of a guide track undulation, and $R_i$ is a polynomial of the form $$R_i = C_1 + \theta_i(C_2 + \theta_i(C_3 + \theta_i(C_4 + \theta_i(C_5 + \theta_i \cdot C_6))))$$

and where:

$\theta_i$ is the angular displacement from the Y axis normalized to lie between 0 and 1 and is denormalized by the relationship $$\theta_n = \theta_i(\theta_f - \theta_s) + \theta_s \text{ and}$$

$\theta_n$ is the total angular displacement from the Y axis, $\theta_s$ is the angular displacement of the start of the profile curve, $\theta_f$ is the angular displacement of the finish of the profile curve, and $C_1$ to $C_6$ are polynomial coefficients.

2. A braiding machine as claimed in claim 1, wherein the radially inner face of the undulations of the guide track is spaced from the outer face of the undulations by an amount accommodating movement of the follower means around the guide track.

3. A braiding machine as claimed in claim 2 wherein the recesses on the horngear assemblies are formed as swinging forks mounted on pivot shafts provided for restricted rotation on the horngear assemblies to augment or decrease the angular velocity imparted directly by the horngear assembly to the follower means, each pivot shaft carrying a cam follower arm provided with a roller cam follower contacting a fixed cam track surface centered on the respective horngear assembly axis, the profile of the fixed cam track surface being determined such that the linear velocity of a spool carrier along the undulating guide track is constant or substantially constant.

4. A braiding machine as claimed in claim 3, wherein resilient biassing means are connected to each roller cam follower and are effective resiliently to bias the roller cam follower into contact with the associated fixed cam track surface.

5. A braiding machine as in claimed in claim 3, wherein the guide track is in the form of a groove and the follower means include boat shaped sliders slidable in the groove and connected, in pairs, to bridge pieces carrying centrally disposed pillars each having a collar seating on horngear plates of the horngear carrier.

6. A braiding machine including a fixed cylindrical housing and mounted on the cylindrical housing, an annular base plate and an annular face plate formed with equi-angularly spaced apertures on a common pitch circle;

mounted on the base plate, posts respectively registering centrally with the equi-angularly spaced apertures in the annular face plate;

rotatably mounted on each post, a horngear assembly including, positioned adjacent the base plate, a toothed gear wheel and, positioned adjacent the face plate, a horngear plate formed with recesses;

the toothed gear wheels of adjaent horngear assemblies being arranged to intermesh and the horngear plates of adjacent horngear assemblies being arranged to co-act to bring the recesses into sequential registration;

associated with each recess, a pivot shaft extending parallel to the posts and mounted for rotation through a restricted arc in bearings on the horngear assembly;

rigidly connected to each pivot shaft, a follower arm carrying a cam roller follower and a drive fork;

positioned on the face plate, and respectively registering with each aperture, a cam track engaging with the associated cam roller follower;

extending around the respective apertures, undulating and intersecting guide track grooves, the grooves intersecting intermediate adjacent apertures;

slidably positioned in the guide track groove, slider means;

mounted on each slider means, a carrier pillar formed with a collar slidably seating on the horngear plate and connection means or a strand spool carrier, the pillar being drivingly engagable by the said drive forks carried on the follower arms to drive the pillar and the associated carrier and slider means along one guide track groove with the drive transferring from a drive fork on one horngear assembly to a drive fork on the adjacent horngear assembly adjacent an intersection of the guide track groove with the other guide track groove; and the guide track grooves having, adjacent the intersection, a curvature, varying smoothly intermediate a constant radius and a straight line and the cam tracks having curvatures arranged to impart an oscillating restricted rotation to the drive forks such that the drive forks propel the slider means along the double undulating intersecting guide track grooves with a constant or substantially constant linear velocity upon the horngear assemblies being rotated with constant angular velocity.

* * * * *